US011974652B2

(12) United States Patent
Bowers

(10) Patent No.: US 11,974,652 B2
(45) Date of Patent: May 7, 2024

(54) MAKEUP EXTENSION WAND SYSTEM

(71) Applicant: Donna Fredrica Bowers, Sussex, NJ (US)

(72) Inventor: Donna Fredrica Bowers, Sussex, NJ (US)

( * ) Notice: Subject to any disclaimer, the term of this patent is extended or adjusted under 35 U.S.C. 154(b) by 146 days.

(21) Appl. No.: 17/351,701

(22) Filed: Jun. 18, 2021

(65) Prior Publication Data

US 2021/0393021 A1 Dec. 23, 2021

Related U.S. Application Data

(60) Provisional application No. 62/705,295, filed on Jun. 19, 2020.

(51) Int. Cl.

| | |
|---|---|
| ***A45D 40/26*** | (2006.01) |
| ***A45D 34/04*** | (2006.01) |
| ***A45D 40/00*** | (2006.01) |
| ***A46B 5/00*** | (2006.01) |

(Continued)

(52) U.S. Cl.

CPC ..... *A45D 40/262* (2013.01); *A45D 34/04* (2013.01); *A46B 5/0041* (2013.01); *A46B 5/0095* (2013.01); *A46B 9/021* (2013.01); *A46B 15/0091* (2013.01); *A46B 15/0095* (2013.01); *A45D 2040/0012* (2013.01); *A45D 2200/1072* (2013.01); *A45D 2200/25* (2013.01); *A46B 2200/1053* (2013.01)

(58) Field of Classification Search

CPC ..... A45D 2200/25; A45D 2040/0012; A45D 2034/007; A45D 42/02; A45D 2040/0018; A45D 2200/05; A45D 33/18; A45D 33/20; A45D 33/22; A45D 40/262; A45D 34/04; A45D 2200/1072; A45D 33/26; A45D 33/28; A45D 2033/001; A45D 34/06; A45D 2034/002; A45D 2040/0006; A45D 2040/201; A45D 40/18; A45D 40/24; A45D 29/18; A45D 29/20; A45D 27/22; A45C 11/008; A46B 15/0091; A46B 9/021; A46B 5/0095; A46B 5/0041; A46B 2200/1053; B25F 1/04; B25B 13/56

USPC ..... 132/218, 314, 315, 317, 294–297, 132/309–311, 76.2, 328; 7/168; 206/373, 38, 372, 379, 376, 362; 81/440–449

See application file for complete search history.

(56) References Cited

U.S. PATENT DOCUMENTS 1,015,026 A * 1/1912 Jackson ..... B25F 1/04 7/168

1,423,405 A * 7/1922 Dayeh ..... A45C 11/008 401/155

(Continued)

*Primary Examiner* — Jacqueline T Johanas
*Assistant Examiner* — Holly T. To
(74) *Attorney, Agent, or Firm* — Olav M. Underdal; IDP Patent Services

(57) ABSTRACT

A makeup extension wand system includes a body, including a frame with left and right vertical frame segment, and a stationary axle; and extension wand assemblies, rotatably and detachably mounted to the stationary axle, each including an extension shaft, an applicator tip, and a connector portion that can be rear or front offset, such that each extension wand assembly is rotatable to a vertical folded-in orientation for storage of the extension wand assembly and to a folded-out orientation for use of the extension wand assembly.

16 Claims, 14 Drawing Sheets

(51) Int. Cl.
*A46B 9/02* (2006.01)
*A46B 15/00* (2006.01)

(56) References Cited

U.S. PATENT DOCUMENTS 1,505,363 A * 8/1924 Mather ..... A46B 5/0095 132/311
1,540,911 A * 6/1925 Soneshein ..... A46B 5/0095 132/309
2,047,331 A * 7/1936 Pollak ..... A45C 11/324 70/456 R
2,556,066 A * 6/1951 Cline ..... A45C 11/008 190/111
2,623,566 A * 12/1952 Renaker ..... A45C 11/008 190/125
2,701,052 A * 2/1955 Martel ..... B25B 15/008 206/377
3,618,346 A * 11/1971 Humphrey ..... A45C 11/324 70/456 R
3,769,991 A * 11/1973 McGrath ..... A61Q 11/00 132/308
4,006,821 A * 2/1977 Sautter ..... B25H 3/003 312/902
4,269,311 A * 5/1981 Rich ..... B25G 1/085 81/177.4
4,596,126 A * 6/1986 Sorensen ..... A45C 11/324 70/456 R
4,756,405 A * 7/1988 Crozier ..... B44D 3/123 206/362
5,215,190 A * 6/1993 Hoffpauir, Jr. ..... A45C 11/324 206/37.8
5,224,234 A * 7/1993 Arsenault ..... A46B 5/0033 15/176.1
5,337,890 A * 8/1994 Lai ..... A45D 40/22 132/304
5,423,427 A * 6/1995 Brown ..... A46B 15/0071 206/362.2
5,586,653 A * 12/1996 Taveroff ..... A45D 40/24 206/229
5,797,489 A * 8/1998 Baker ..... B44D 3/04 206/362
D455,630 S * 4/2002 Chiu ..... D8/87
6,398,027 B1 * 6/2002 Ryu ..... A45C 11/008 206/362
7,168,559 B2 * 1/2007 Chen ..... B25H 3/003 206/379
8,007,192 B2 8/2011 Huang
8,186,510 B1 * 5/2012 Chen ..... B25H 3/003 206/751
8,998,520 B1 4/2015 Tanner
9,241,553 B1 * 1/2016 Winston ..... A45C 11/008
9,301,592 B2 4/2016 Hofmann
9,468,280 B2 * 10/2016 Uehara ..... A45D 34/045
9,603,443 B2 * 3/2017 Boyke ..... A46B 11/0065
10,166,670 B2 * 1/2019 Larsson ..... B25H 3/003
10,349,729 B1 7/2019 Cheema et al.
10,588,389 B1 * 3/2020 Ruiz ..... A41G 5/02
10,624,430 B1 * 4/2020 Godwin, III ..... A24F 15/12
10,631,628 B1 * 4/2020 Montford ..... A46B 17/02
11,229,267 B2 * 1/2022 Van Der Laan ..... A45C 11/324
2004/0020508 A1 * 2/2004 Earl ..... A46B 5/0041 132/311
2004/0035437 A1 2/2004 Gueret
2004/0168700 A1 * 9/2004 Dorf ..... A45D 33/00 132/313
2005/0161356 A1 * 7/2005 Chen ..... B25H 3/003 206/378
2005/0194021 A1 * 9/2005 Byun ..... A45D 40/221 132/295
2005/0278866 A1 * 12/2005 Madarieta ..... B25F 1/04 7/165
2006/0013639 A1 * 1/2006 Gueret ..... A45D 34/045 401/122
2006/0064832 A1 * 3/2006 Caramico ..... A46B 5/0041 15/106
2006/0219256 A1 * 10/2006 Byun ..... A45D 33/20 132/287
2007/0284386 A1 * 12/2007 Shoemaker ..... A45C 11/008 221/63
2008/0011634 A1 * 1/2008 Lin ..... B25H 3/003 206/372
2008/0142031 A1 * 6/2008 Francis ..... A45D 33/22 132/294
2008/0173324 A1 * 7/2008 Washington ..... A45D 33/24 132/294
2009/0308782 A1 * 12/2009 Grist ..... A45C 11/008 132/316
2010/0003065 A1 1/2010 Haan
2010/0147710 A1 * 6/2010 Lebauer ..... A45D 29/20 206/320
2010/0212686 A1 * 8/2010 Lai ..... A45D 33/20 132/287
2010/0300476 A1 * 12/2010 Bennett ..... A45D 40/262 132/316
2011/0073498 A1 * 3/2011 Palmer ..... A45C 11/324 206/38
2011/0073499 A1 * 3/2011 Palmer ..... A45C 11/008 206/38
2011/0089078 A1 * 4/2011 Ziemba ..... A45C 1/04 206/581
2011/0174680 A1 7/2011 Arvin et al.
2012/0048290 A1 * 3/2012 Cappello ..... A45D 40/24 132/316
2012/0261042 A1 * 10/2012 Khubani ..... A45C 13/1084 150/143
2014/0082868 A1 * 3/2014 Naicker ..... B25F 1/04 15/105
2015/0055999 A1 * 2/2015 Lim ..... A46B 5/0041 401/125
2015/0201733 A1 * 7/2015 Brogoitti ..... A45D 40/18 132/288
2015/0272297 A1 10/2015 Gordon-Bryan
2016/0075475 A1 * 3/2016 Apodaca ..... A45D 40/26 220/6
2016/0128447 A1 * 5/2016 Lim ..... A45D 34/042 132/317
2017/0072546 A1 * 3/2017 Edmonds ..... A46B 9/026
2017/0238678 A1 8/2017 Manici et al.
2017/0325576 A1 11/2017 Griffith
2018/0153293 A1 6/2018 Dovellos et al.
2018/0317629 A1 * 11/2018 DeSimone ..... A46B 15/0093
2019/0029399 A1 1/2019 Kim
2019/0110579 A1 * 4/2019 Piszek ..... B25H 3/006
2019/0133276 A1 * 5/2019 Fagu ..... B43M 99/006
2019/0283921 A1 * 9/2019 Stamoulis ..... A45C 11/24
2019/0366758 A1 * 12/2019 Hutchison ..... B44D 3/125
2020/0015568 A1 1/2020 Kang
2020/0128939 A1 * 4/2020 Kim ..... A45D 33/006
2020/0146424 A1 * 5/2020 Edgemon ..... A45D 40/24
2020/0154854 A1 * 5/2020 Kennedy Zdanow ..... A45D 40/261
2020/0305578 A1 10/2020 Faria
2021/0204685 A1 * 7/2021 Christensen ..... A46B 5/0058
2021/0212449 A1 7/2021 Dai
2021/0259387 A1 * 8/2021 Salas ..... A45D 33/22
2021/0393021 A1 * 12/2021 Bowers ..... A46B 15/0091
2022/0304446 A1 * 9/2022 Crisostomo Silva ..... A46B 15/0055
2023/0060372 A1 * 3/2023 Ruiz ..... A41G 5/02

* cited by examiner

MAKEUP EXTENSION WAND SYSTEM

CROSS-REFERENCE TO RELATED APPLICATIONS

This application claims the benefit of U.S. Provisional Application No. 62/705,295, filed Jun. 19, 2020; which is hereby incorporated herein by reference in its entirety.

FIELD OF THE INVENTION

The present invention relates generally to the field of makeup applicators, and more particularly to methods and systems which incorporate a plurality of makeup extension wand.

BACKGROUND OF THE INVENTION

Users of makeup will normally possess a number of different makeup products, each with some form of applicator or mechanism of application. For some products, such as mascara and liquid eye liner, they will typically include a bottle that is closed with a cover with an attached wand, which comprises an applicator tip on an outer end of the wand.

However, when the product is almost used up, typically the restricted length of the attached wand will make it impossible to use the final remains of the product, which ends up being discarded, thereby wasting up to 3-5% of the purchased product.

Similarly for stick-based products, such as lipstick and stick-based lip gloss, some stick portions will remain in the main body of the stick-based products, and cannot be removed without the use of a separate extraction tool, thereby typically causing waste when discarding a used stick-based products.

Although some wand extenders are available, there are no tools which facilitate complete extraction of all makeup remains across a full range of conventional makeup products. Therefore, most users will experience ongoing waste by only being able to use 95-97% of the makeup contents in the various makeup products they use.

As such, considering the foregoing, it may be appreciated that there continues to be a need for novel and improved devices and methods for makeup extension wands.

SUMMARY OF THE INVENTION

The foregoing needs are met, to a great extent, by the present invention, wherein in aspects of this invention, enhancements are provided to the existing model of makeup extension wands.

In an aspect, a makeup extension wand system can include:

a) a body; and b) a plurality of extension wand assemblies, wherein an outer portion of each extension wand assembly in the plurality of extension wand assemblies can be configured for use to extract makeup from a makeup container, such that the makeup is deposited on the outer portion, such that the outer portion can be used to apply the makeup;

wherein each extension wand assembly in the plurality of extension wand assemblies can be rotatably connected to the body, such that each extension wand assembly can be rotatable to a vertical folded-in orientation for storage of the extension wand assembly and to a folded-out orientation for use of the extension wand assembly.

In a related embodiment, each extension wand assembly in the plurality of extension wand assemblies can include:

a) an extension shaft, wherein an inner end of the extension shaft is rotatably connected to the body;

b) an applicator tip, which is connected to an outer end of the extension shaft, such that the applicator tip is configured for use to extract (from a makeup container) and apply (on a face or body part of a user) the makeup; and c) a connector portion, wherein an outer end of the connector portion can be detachably connected to an inner end of the extension shaft, for example such that the extension shaft screws in and out, or attaches with a detachable snap-lock connection;

and wherein an inner end of the connector portion can be detachably and rotatably connected to the body.

In a further related embodiment, an applicator tip of an extension wand assembly in the plurality of extension wand assemblies can be one of:

a) A liquid eyeliner applicator tip, which is configured to extract and apply liquid eyeliner makeup;

b) A mascara applicator tip, which is configured to extract and apply mascara makeup;

c) A lip gloss applicator tip, which is configured to extract and apply lip gloss makeup;

d) A lip stick applicator tip, which is configured to extract and apply lip stick makeup; or e) A foundation applicator tip, which is configured to extract and apply foundation makeup.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
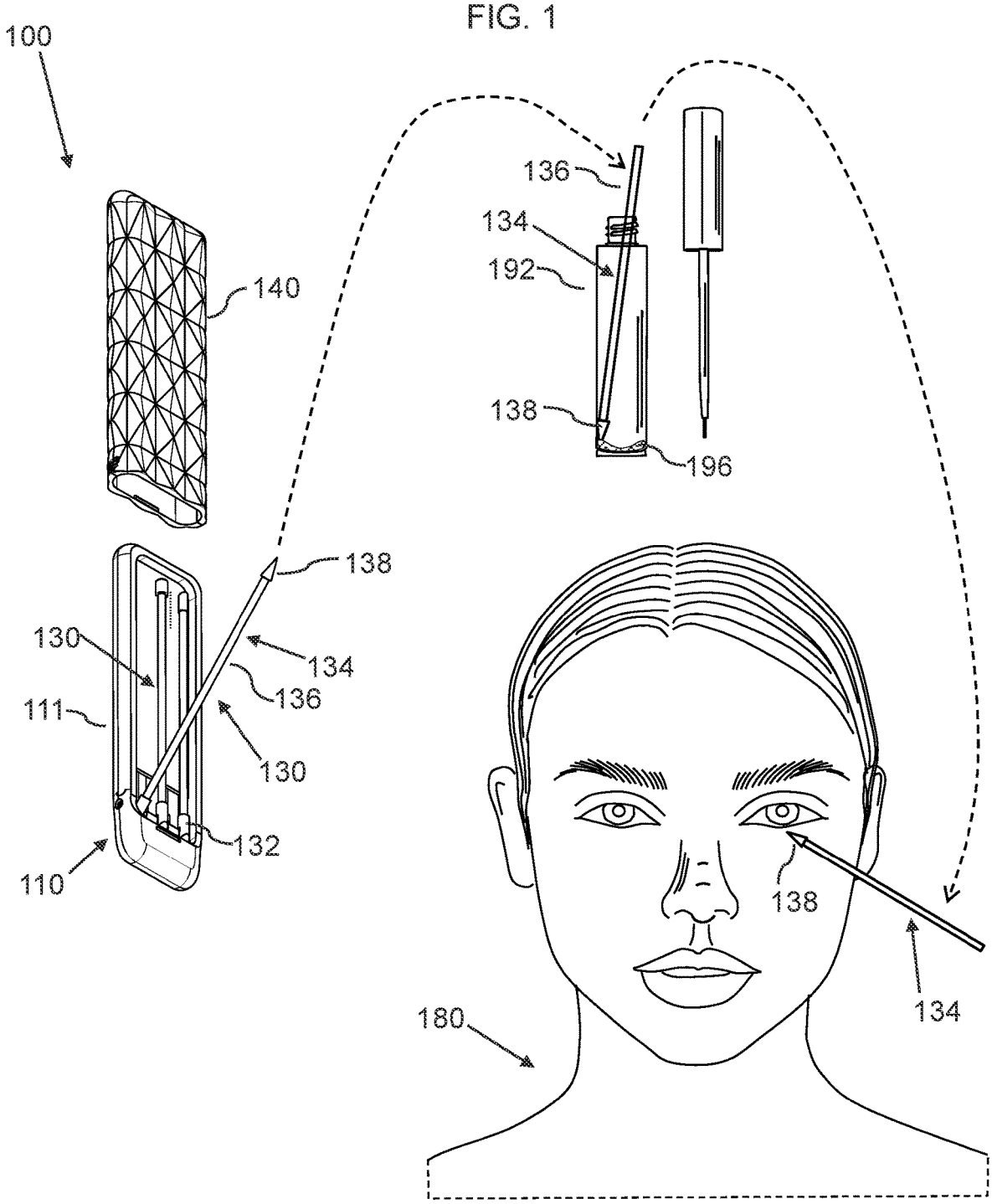
FIG. 1 is a schematic perspective view of a makeup extension wand system with the cover detached showing a process of use, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a makeup extension wand system 100 with reference to FIGS. 1, 2A, and 2B, in such manner that like reference numerals refer to like components throughout; a convention that we shall employ for the remainder of this specification.

Figure 2A:
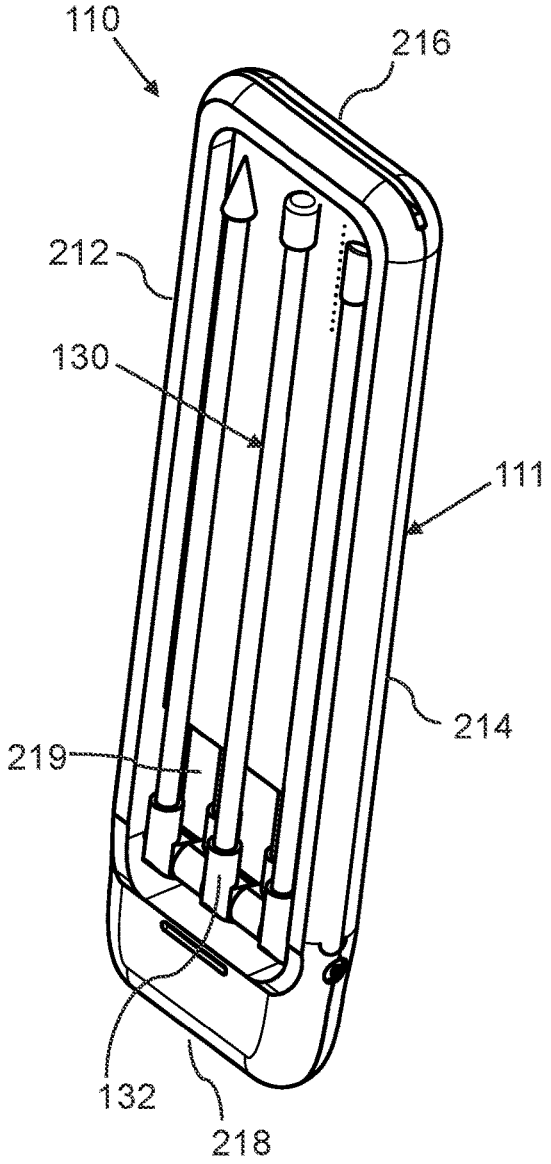
FIG. 2A is a front top perspective view of a makeup extension wand system with the cover removed, according to an embodiment of the invention.
Figure 2B:
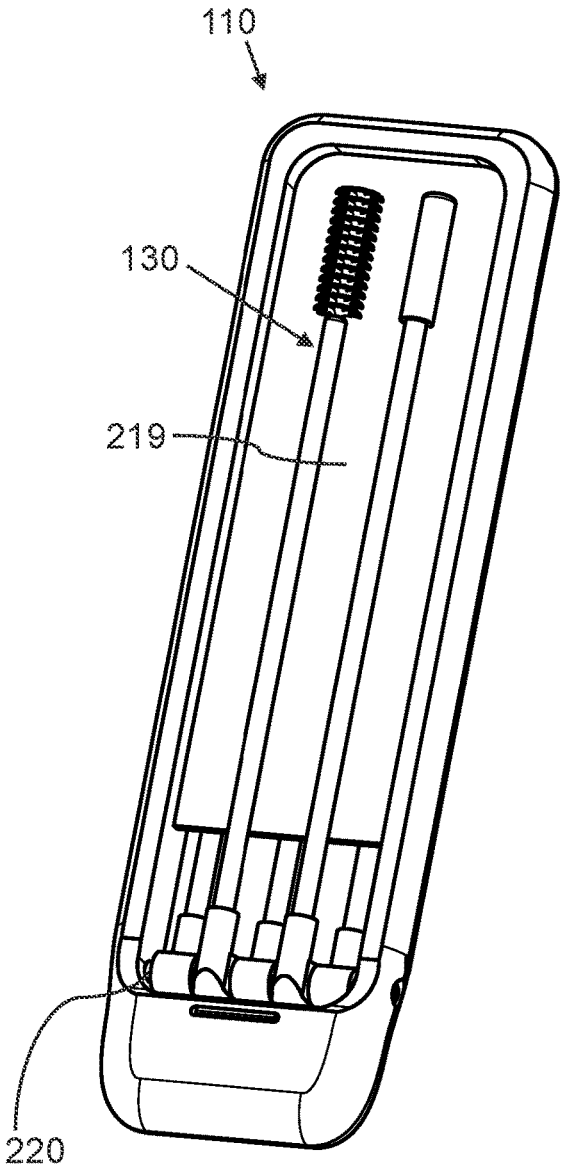
FIG. 2B is a rear bottom perspective view of a makeup extension wand system with the cover removed, according to an embodiment of the invention.
Figure 4A:
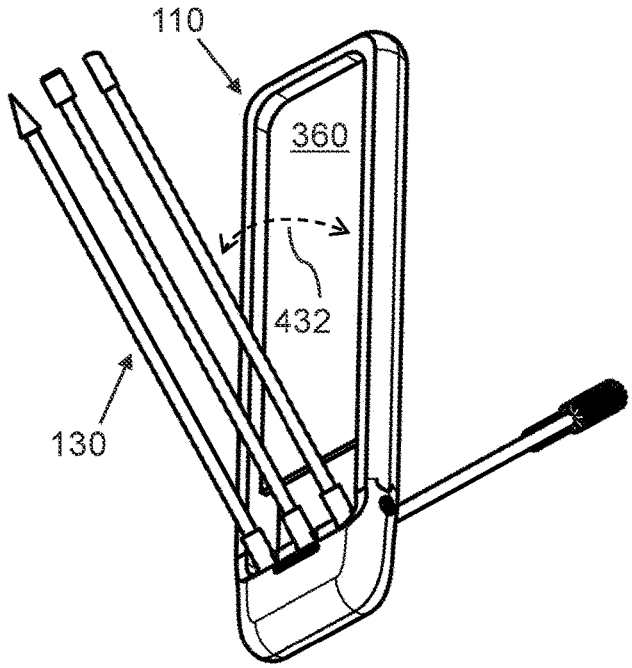
FIG. 4A is a front bottom perspective view of a makeup extension wand system with the cover removed, wherein the wand assemblies are rotated out to a 45-degree angle, according to an embodiment of the invention.
Figure 4B:
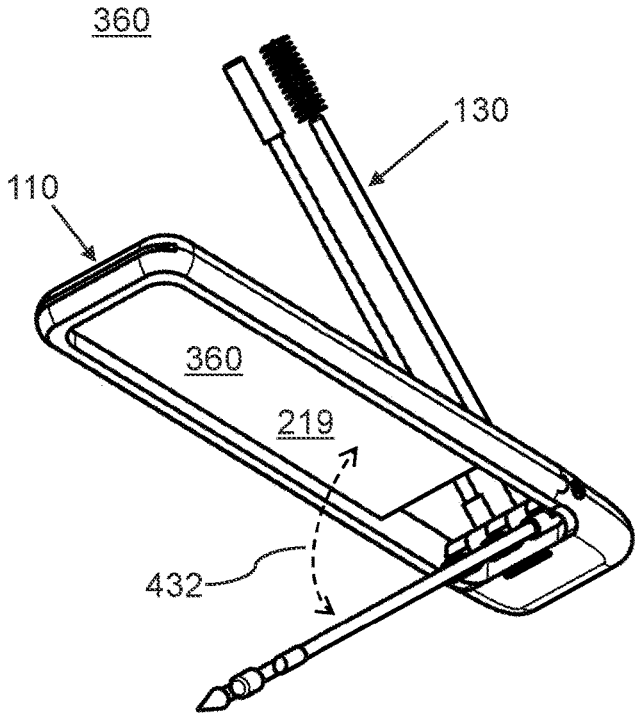
FIG. 4B is a front top perspective view of a makeup extension wand system with the cover removed, wherein the wand assemblies are rotated outward to a 45-degree angle, according to an embodiment of the invention.
Figure 4C:
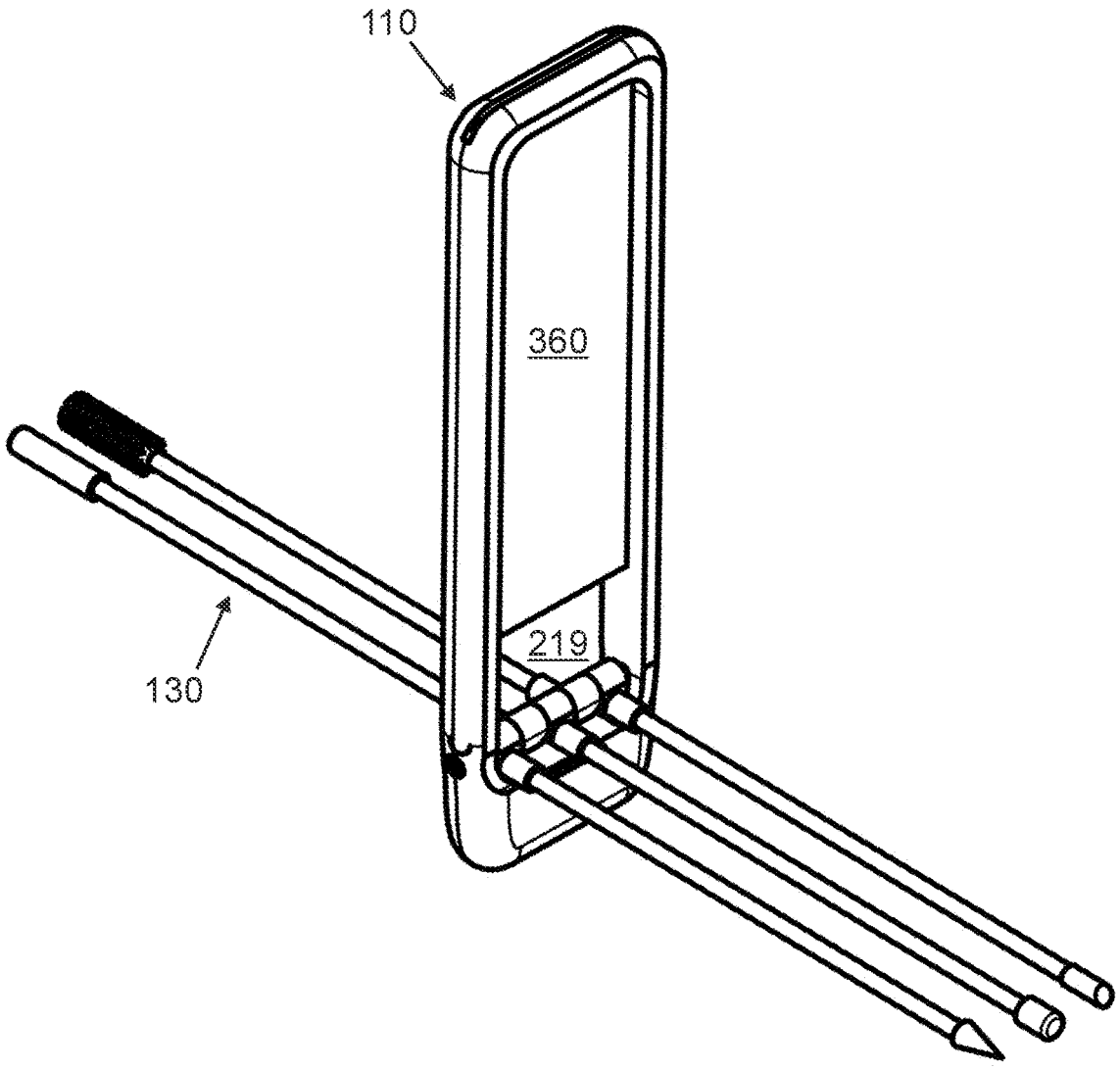
FIG. 4C is a front top perspective view of a makeup extension wand system with the cover removed, wherein the wand assemblies are rotated outward to a 90-degree angle, according to an embodiment of the invention.
Figure 5A:
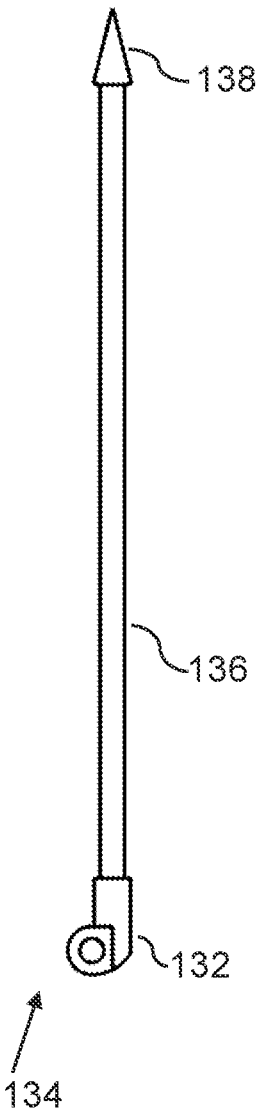
FIG. 5A is a left view of a wand assembly of a makeup extension wand, according to an embodiment of the invention.
Figure 5B:
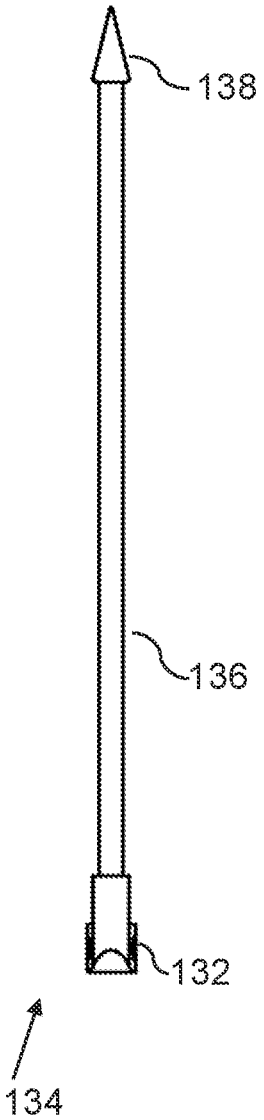
FIG. 5B is a front view of a wand assembly of a makeup extension wand, according to an embodiment of the invention.
Figure 5C:
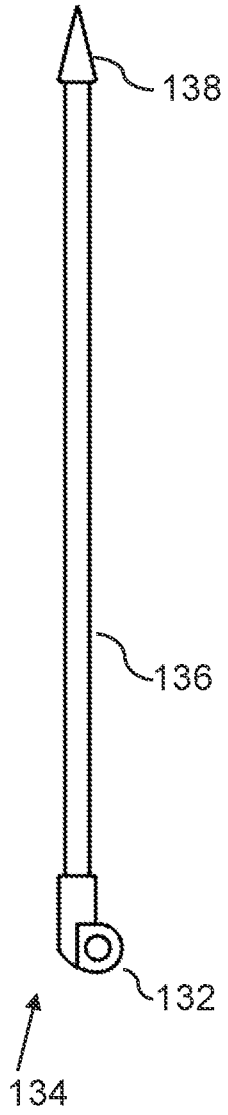
FIG. 5C is a right view of a wand assembly of a makeup extension wand, according to an embodiment of the invention.
Figure 7A:
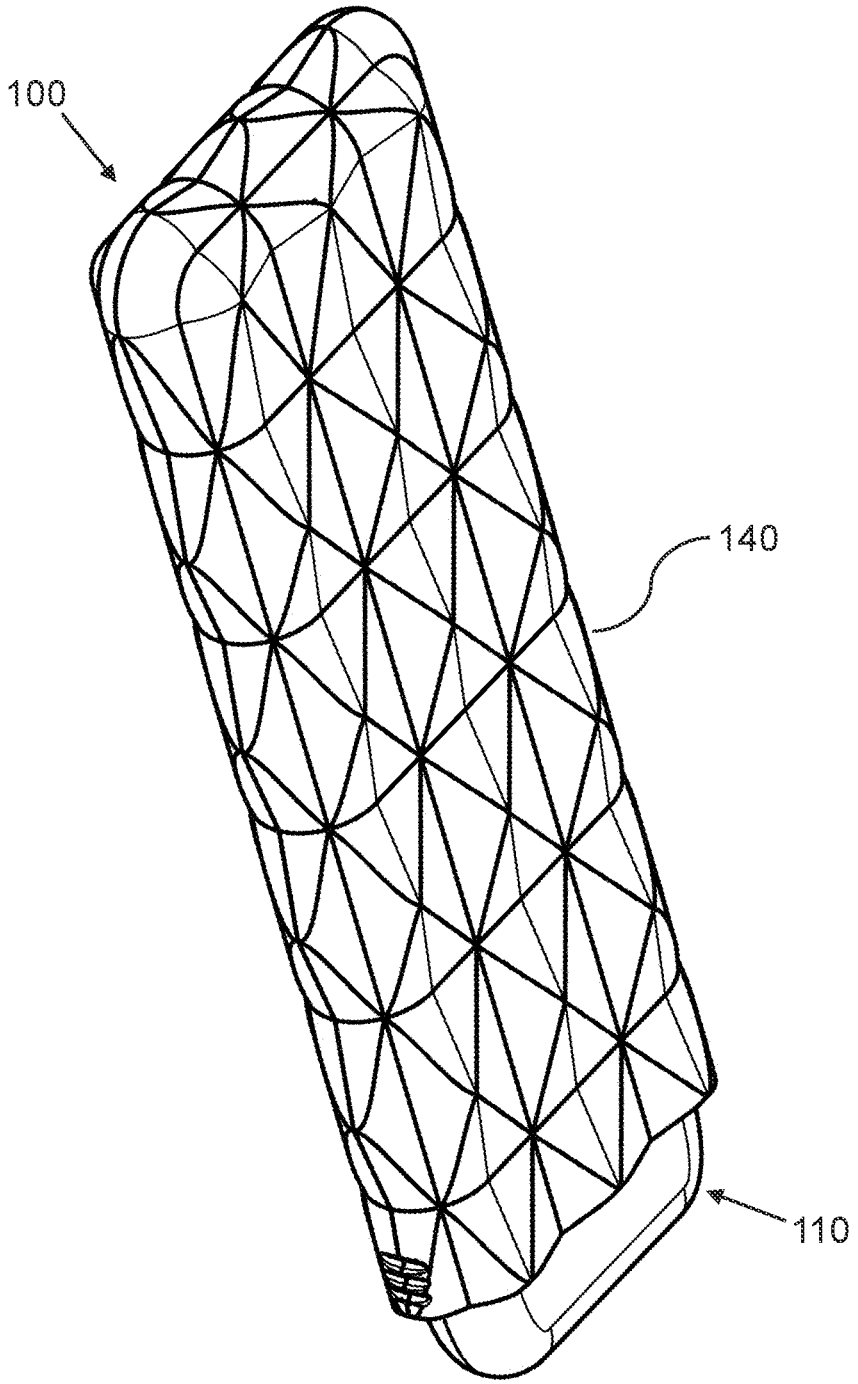
FIG. 7A is a top perspective view of a makeup extension wand system with the cover mounted, according to an embodiment of the invention.
Figure 7B:
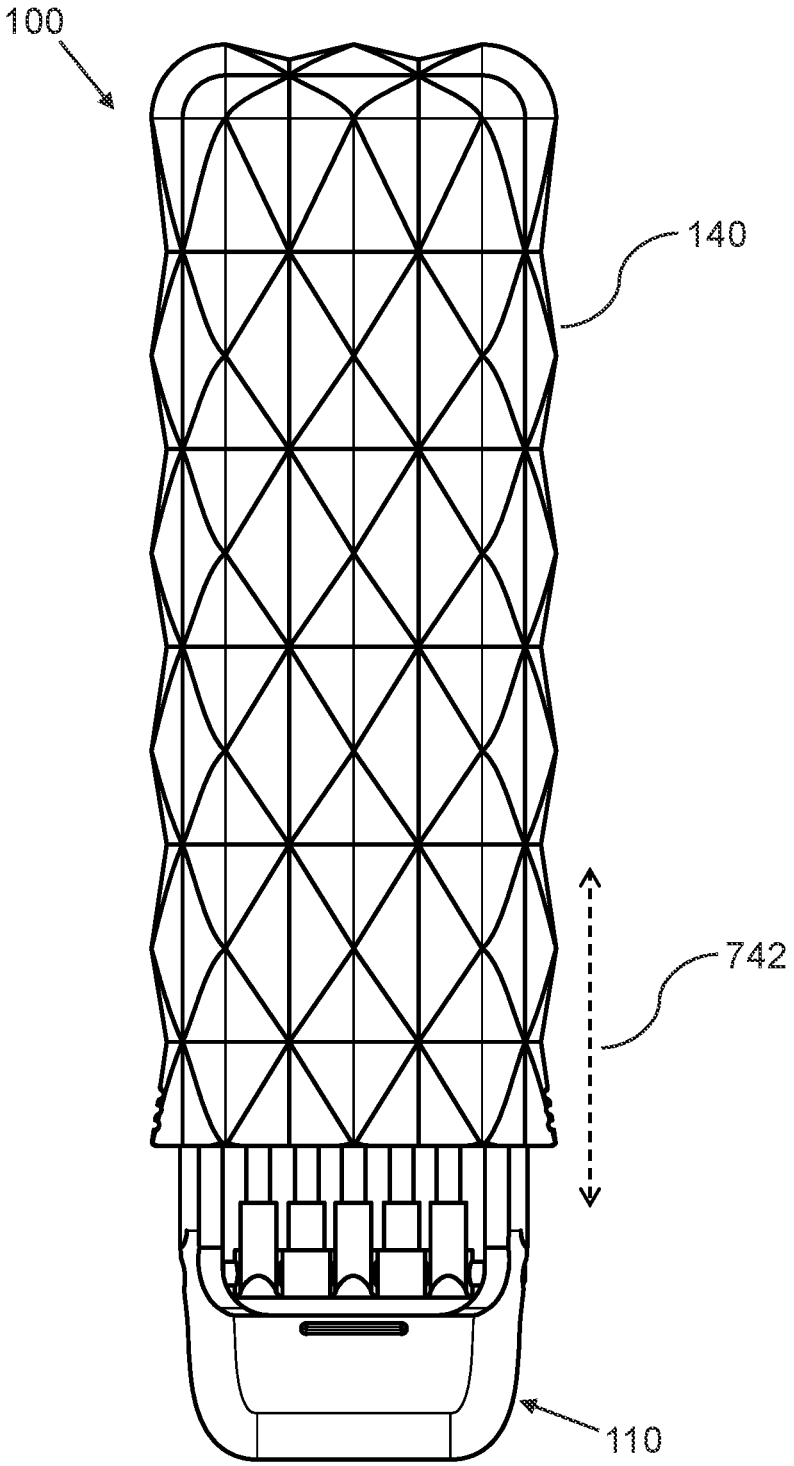
FIG. 7B is a front view of a makeup extension wand system with the cover partially lifted, according to an embodiment of the invention.
Figure 7C:
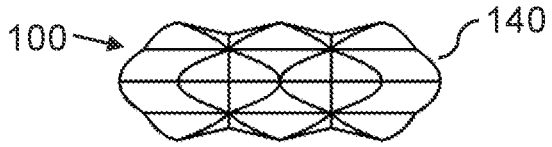
FIG. 7C is a top view of a makeup extension wand system with the cover mounted, according to an embodiment of the invention.
Figure 7D:
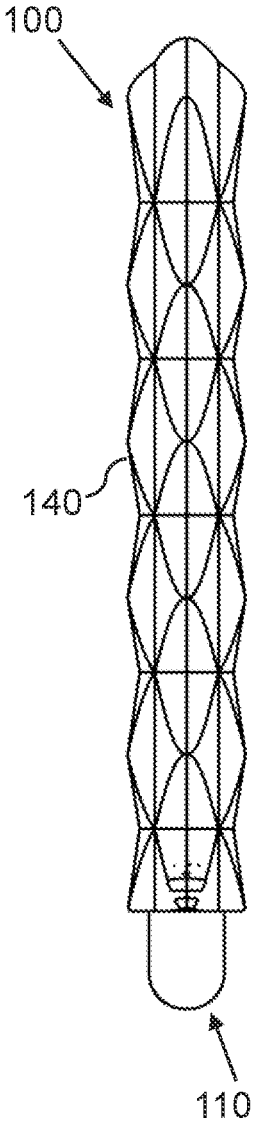
FIG. 7D is a left side view of a makeup extension wand system with the cover mounted, according to an embodiment of the invention.
Figure 7E:
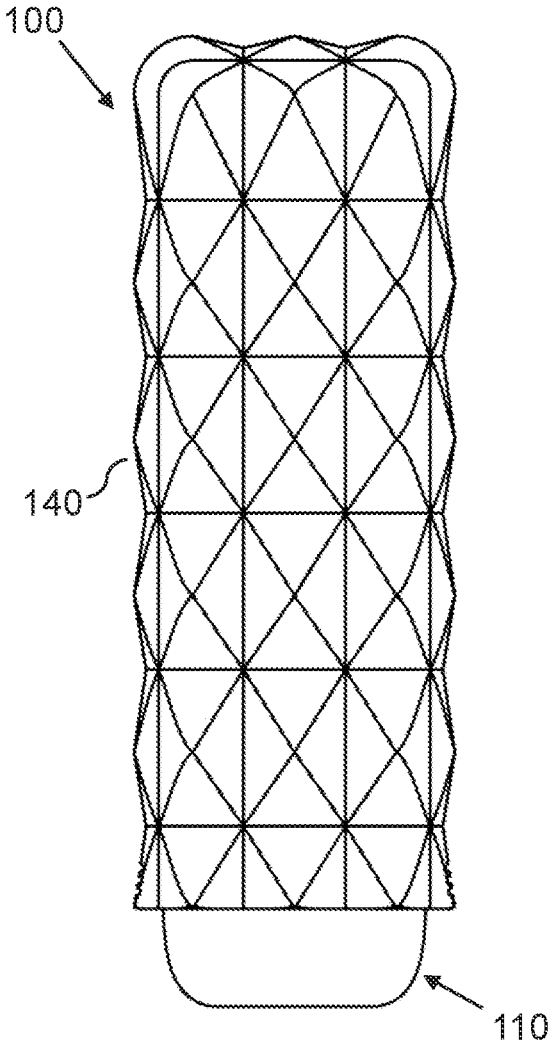
FIG. 7E is a front view of a makeup extension wand system with the cover mounted, according to an embodiment of the invention.
Figure 7F:
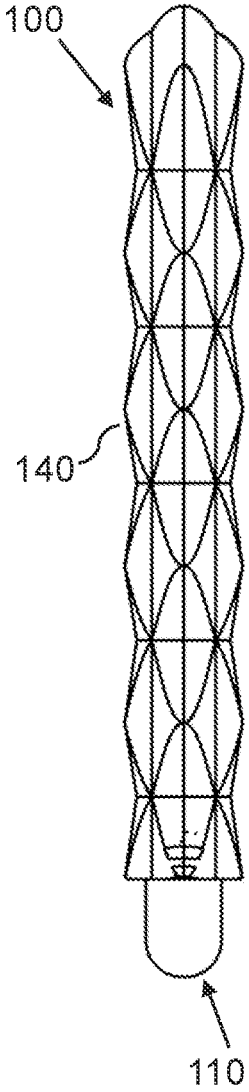
FIG. 7F is a right side view of a makeup extension wand system with the cover mounted, according to an embodiment of the invention.
Figure 7G:
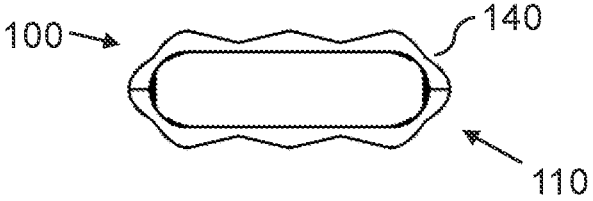
FIG. 7G is a bottom view of a makeup extension wand system with the cover mounted, according to an embodiment of the invention.

In an embodiment, as shown in FIGS. 1, 2A, and 4A, a makeup extension wand system 100 can include:

a) a body 110;

b) a plurality of extension wand assemblies 130, wherein an outer portion of each extension wand assembly 130 in the plurality of extension wand assemblies 130 can be configured for use to extract makeup 196 from a makeup container 192, such that the makeup 196 is deposited on the outer portion 138, such that the outer portion 138 can be used to apply the makeup 196; and c) a cover 140, which is configured to removably slide 742 over at least an upper part of the body 110, such that the plurality of extension wand assemblies 130 are covered by the cover 140, when each of the extension wand assemblies 130 are positioned in the folded-in orientation, as shown in FIGS. 7A and 7B;

wherein each extension wand assembly 130 in the plurality of extension wand assemblies 130 can be rotatably 432 connected to the body 110, such that each extension wand assembly 130 can be rotatable to a folded-in orientation (i.e. a vertical orientation relative to the frame 111) for storage of the extension wand assembly 130 and to a folded-out orientation for use of the extension wand assembly 130;

wherein the cover 140 can be positioned/slid over the upper part of the body 110 when each extension wand assembly 130 is rotated to the vertical orientation, as shown in FIG. 7A;

wherein, in order to access the extension wand assemblies 130, the cover 140 can be lifted (slid up), as shown in FIG. 7B, and fully removed from the body 110, as shown in FIG. 1.

In a related embodiment, each extension wand assembly 130 in the plurality of extension wand assemblies 130 can include:

a) a detachable shaft assembly 134, which can include i. an extension shaft 136, wherein an inner end of the extension shaft is detachably and rotatably connected to the body 110;

ii. an applicator tip 138, which is connected to an outer end of the extension shaft 136, such that the applicator tip 138 is configured for use to extract (from a makeup container) and apply (on a face or body part of a user 180) the makeup; and b) a connector portion 132, wherein an outer end of the connector portion 132 can be detachably connected to an inner end of the extension shaft 136, for example such that the extension shaft 136 fits with a friction fit in an aperture of the connector portion, screws in and out, or attaches with a detachable snap-lock connection, such that the detachable shaft assembly 134 is detachably connected to the rotatable connector portion 132;

and wherein an inner end of the connector portion 132 can be detachably and rotatably connected to the body 110.

Figure 6A:
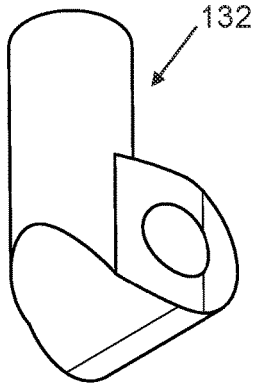
FIG. 6A is a front bottom perspective view of a connector portion for connecting to an axle of the makeup extension wand system, according to an embodiment of the invention.
Figure 6B:
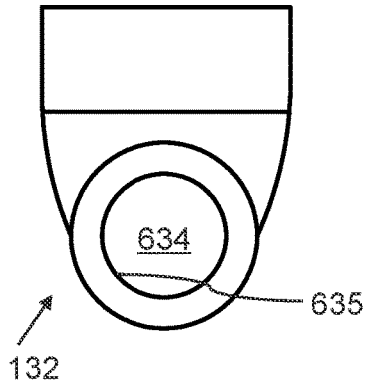
FIG. 6B is a top view of a connector portion for connecting to an axle of the makeup extension wand system, according to an embodiment of the invention.
Figure 6C:
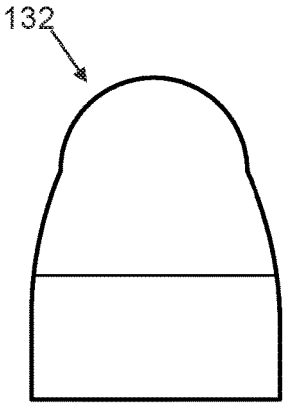
FIG. 6C is a bottom view of a connector portion for connecting to an axle of the makeup extension wand system, according to an embodiment of the invention.
Figure 6D:
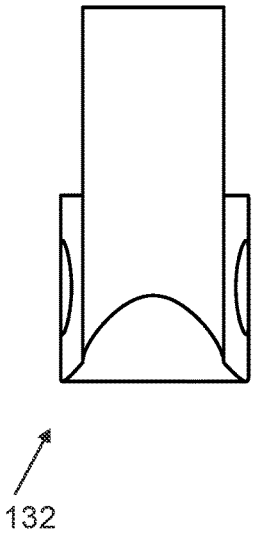
FIG. 6D is a front view of a connector portion for connecting to an axle of the makeup extension wand system, according to an embodiment of the invention.
Figure 6E:
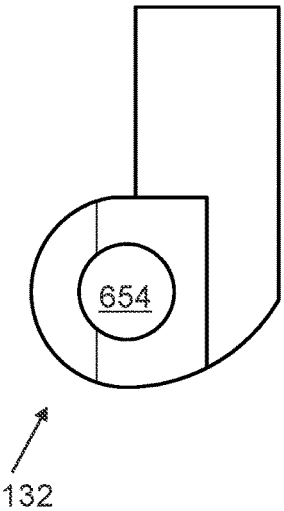
FIG. 6E is a side view of a connector portion for connecting to an axle of the makeup extension wand system, according to an embodiment of the invention.

In a related embodiment, the outer end of the connector portion 132 can further include:

a) a connector aperture 634, as shown in FIG. 6B, which can be narrowing from an entrance to a bottom of the connector aperture 634, wherein the inner end of the extension shaft 136 is configured to slide into the connector aperture 634, such that the shaft assembly 134 is releasably held in position by a friction fit between the connector aperture 634 and the inner end of the extension shaft 136.

In a related embodiment, the outer end of the connector portion 132 can further include:

a) a snap-lock connector 634, such that the inner end of the extension shaft 136 is configured to detachably snap into the snap-lock connector 634.

In another related embodiment, the outer end of the connector portion 132 can further include:

a) a threaded 635 aperture 634, wherein the inner end of the extension shaft 136 is threaded, such that the inner end of the extension shaft 136 is configured to screw into the threaded 635 aperture 634.

Figure 3A:
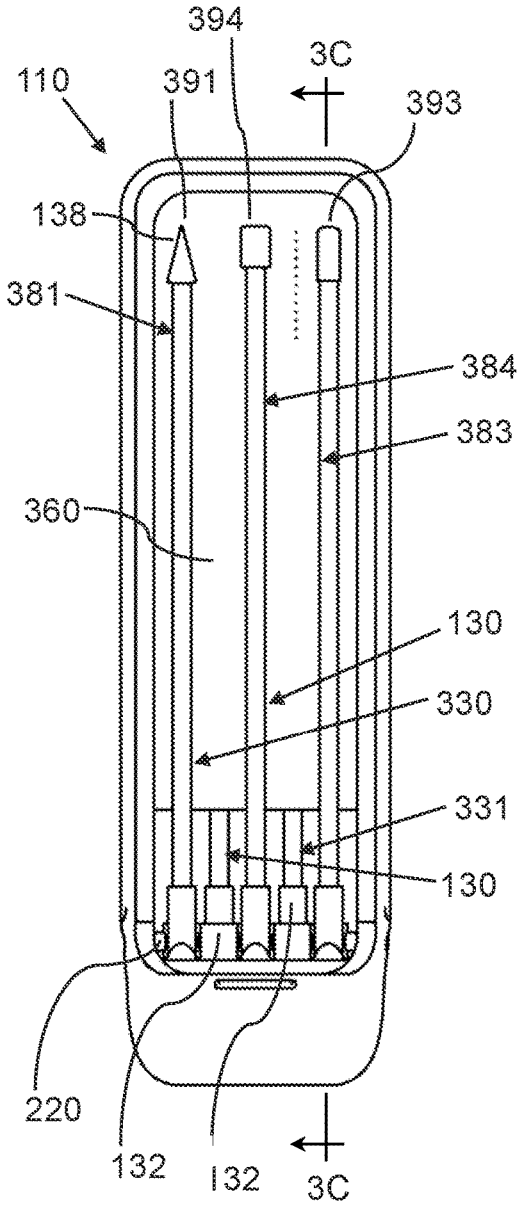
FIG. 3A is a front view of a makeup extension wand system with the cover removed, according to an embodiment of the invention.
Figure 3B:
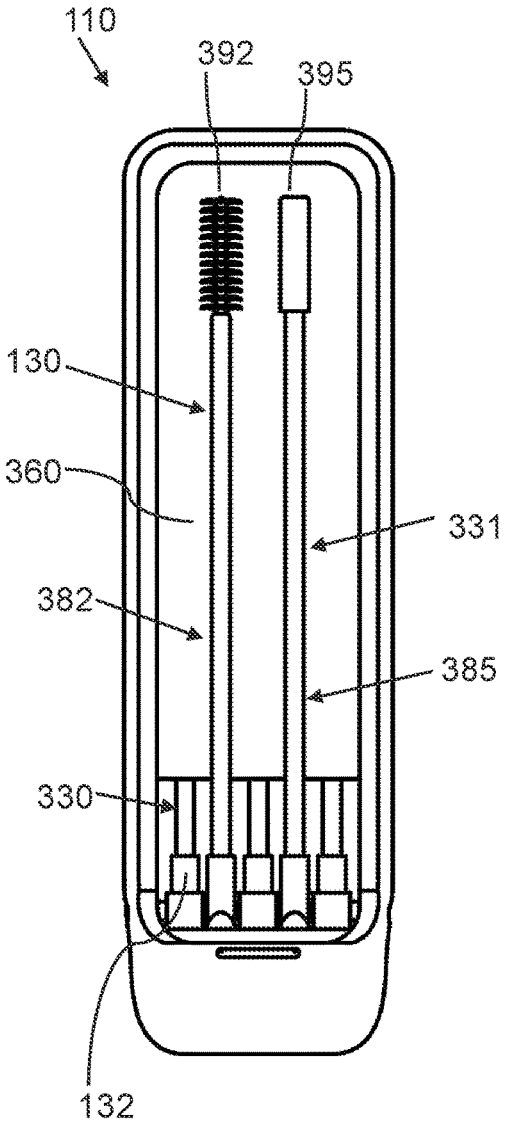
FIG. 3B is a rear view of a makeup extension wand system with the cover removed, according to an embodiment of the invention.

In a further related embodiment, as shown in FIGS. 3A and 3B, an applicator tip 138 of an extension wand assembly 130 in the plurality of extension wand assemblies 130 can be one of (i.e. selected from the group consisting of):

a) A liquid eyeliner applicator tip 391, which is configured to extract and apply liquid eyeliner makeup;

b) A mascara applicator tip 392, which is configured to extract and apply mascara makeup;

c) A lip gloss applicator tip 393, which is configured to extract and apply lip gloss makeup;

d) A lip stick applicator tip 394, which is configured to extract and apply lip stick makeup;

e) A foundation applicator tip 395, which is configured to extract and apply foundation makeup; or f) Another type of make applicator tip 138, which can be configured to extract and apply any particular form of makeup, including makeup that is configured as a powder, a compacted powder, a semi-solid, a solid, a liquid, a gel, etc.

In a further related embodiment, as shown in FIGS. 3A and 3B, the makeup extension wand system 100 can include at least five extension wand assemblies 130, such that the plurality of extension wand assemblies 130 includes:

a) a first extension wand assembly 381, comprising a first applicator tip 138, which is configured as a liquid eyeliner applicator tip 391;

b) a second extension wand assembly 382, comprising a second applicator tip 138, which is configured as a mascara applicator tip 392;

c) a third extension wand assembly 383, comprising a third applicator tip 138, which is configured as a lip gloss applicator tip 393;

d) a fourth extension wand assembly 384, comprising a fourth applicator tip 138, which is configured as a lip stick applicator tip 394; and e) a fifth extension wand assembly 385, comprising a fifth applicator tip 138, which is configured as a foundation applicator tip 395.

In related embodiments, a number of extension wand assemblies 130, can vary depending on variation of a width of the frame 111, and a width of each extension wand assembly 381. Some extension wand assemblies 384 mounted in a makeup extension wand system 100 may be duplicated (i.e. be the same).

In a related embodiment, at least a surface portion of or the entire liquid eyeliner applicator tip 391 can be made from:

a) a rubber material, such as natural latex rubber, or synthetic rubber, such as a silicone rubber;

b) a flocked material, such as a flocked fiber material or a flocked fabric material; or c) another type of material suitable for use as a liquid eyeliner applicator.

In a related embodiment, the mascara applicator tip 392 can be configured as a brush, which can be textured, and can be made from natural or synthetic bristles.

In a related embodiment, at least surface portions of or the entire lip gloss applicator tip 393 can be made from:

a) a rubber material, such as natural latex rubber, or synthetic rubber, such as a silicone rubber;

b) a flocked material, such as a flocked fiber material or a flocked fabric material; or c) another type of material suitable for use as a lip gloss applicator.

In a related embodiment, at least surface portions of or the entire lip stick applicator tip 394 can be made from:

a) a rubber material, such as natural latex rubber, or synthetic rubber, such as a silicone rubber;

b) a flocked material, such as a flocked fiber material or a flocked fabric material; or c) another type of material suitable for use as a lip stick applicator.

In a related embodiment, at least surface portions of or the entire foundation applicator tip 395 can be made from:

a) a rubber material, such as natural latex rubber, or synthetic rubber, such as a silicone rubber;

b) a flocked material, such as a flocked fiber material or a flocked fabric material; or c) another type of material suitable for use as a foundation applicator.

In another further related embodiment, as shown in FIGS. 2A, 2B, 4B, and 4C, and the body 110 can further include:

a) a frame 111, which can further include:

i. a left vertical frame segment 212;

ii. a right vertical frame segment 214;

iii. a top horizontal frame segment 216, which can be connected between top ends of the left and right vertical frame segments 212, 214; and iv. a bottom horizontal frame segment 218, which can be connected between bottom ends of the left and right vertical frame segments 212, 214;

such that the frame 111 forms a frame opening 219, which is formed between the left and right vertical frame segment 212, 214 and the top and bottom horizontal frame segment 216, 218; and b) a stationary axle 220, which can be connected between the left and right vertical frame segment 212, 214, in a lower portion of the frame opening 219;

such that the inner end of each connector portion 132 is rotatably connected to the stationary axle 220;

such that each extension wand assembly 130 can be rotatable to a folded-in orientation (relative to the frame 111) at least partially inside the frame opening 219, and can be rotatable to folded-out orientation for use of the extension wand assembly 130, such that the extension shaft 136 can be detached with the attached applicator tip 138 exposed for use.

In a yet further related embodiment, the inner end of the connector portion 132 can further comprise:

a) a central aperture 654, such that the connector portion 132 can slide onto the stationary axle 220, such that the stationary axle 220 protrudes trough the central aperture 654, such that the connector portion 132 is rotatably connected to the stationary axle.

Figure 6F:
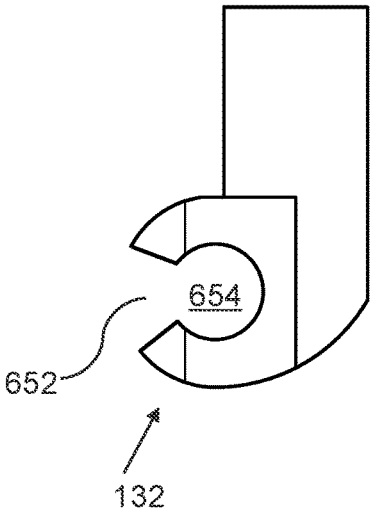
FIG. 6F is a side view of a connector portion for connecting to an axle of the makeup extension wand system, according to an embodiment of the invention.
Figure 8A:
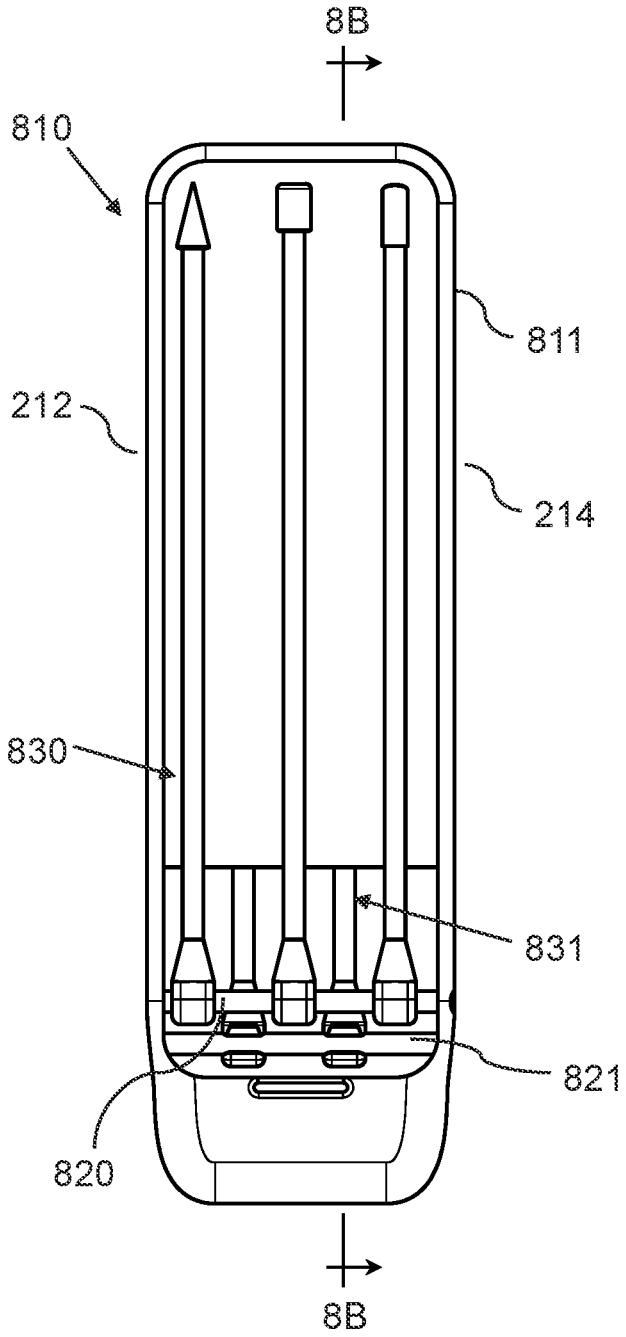
FIG. 8A is a front view of a dual-axle makeup extension wand system without the cover, according to an embodiment of the invention.
Figure 8B:
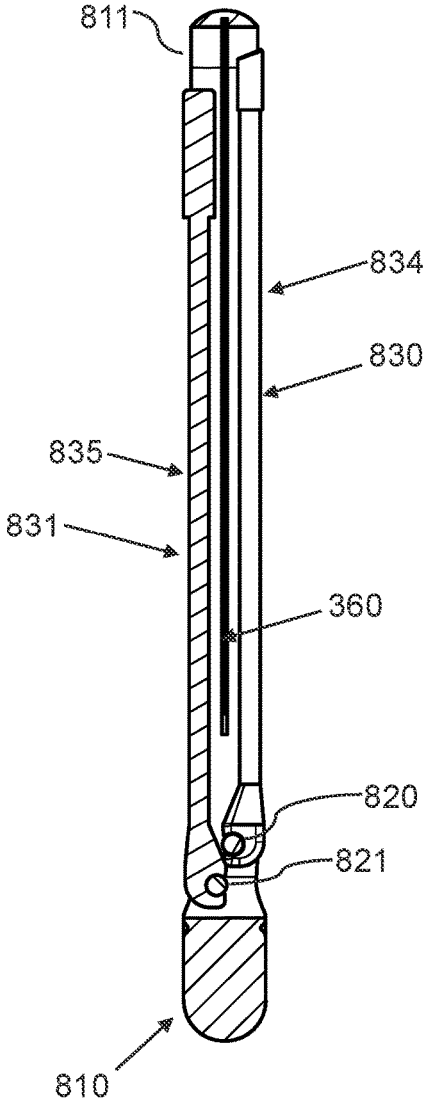
FIG. 8B is a cross-sectional side view of the dual-axle makeup extension wand system, taken along section line 8B-8B of FIG. 8A, according to an embodiment of the invention.

In another related embodiment, as shown in FIGS. 6F, 8A, and 8B, the inner end of the connector portion 132 can further include a flexible snap-in opening 652, which is connected to the central aperture 654, such that the connection portion 132 is configured to detachably snap onto the stationary axle 220.

Figure 3C:
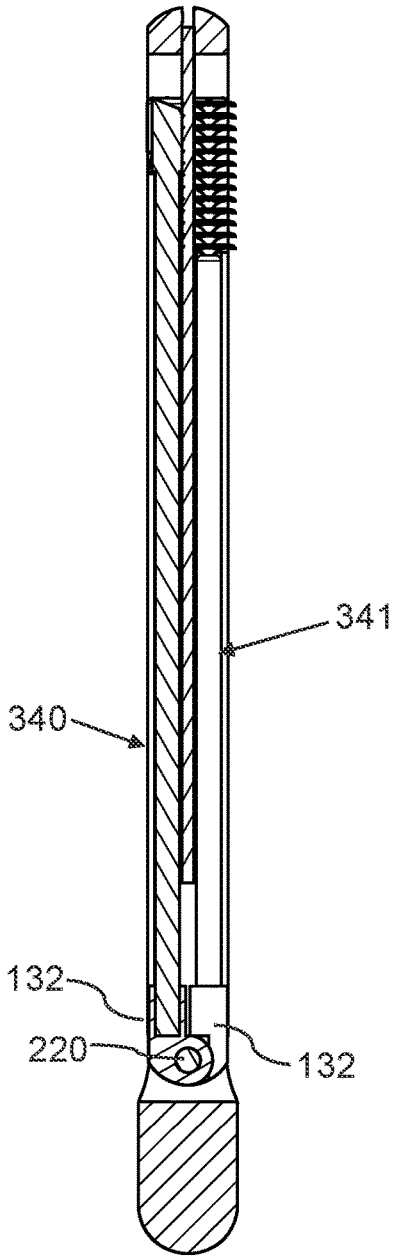
FIG. 3C is a cross-sectional side view of a makeup extension wand system with the cover removed, taken along section line 3C-3C of FIG. 3A, according to an embodiment of the invention.
Figure 3D:
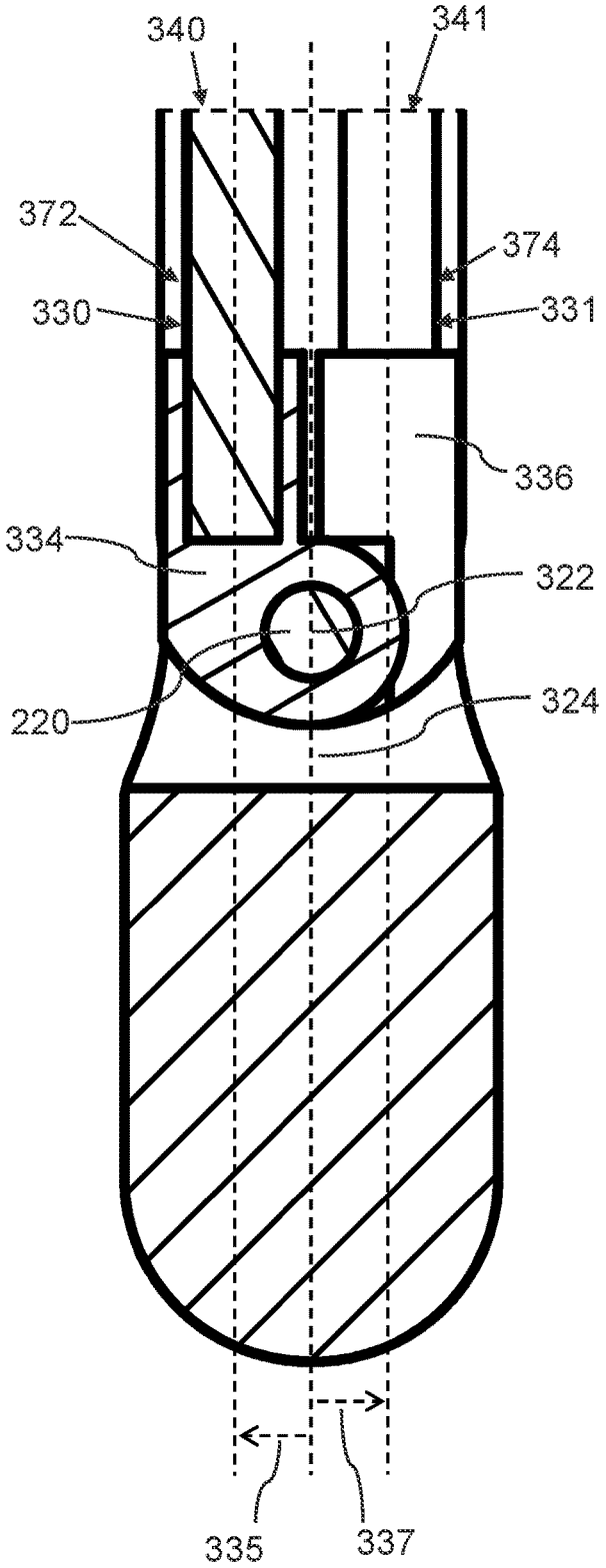
FIG. 3D is a cross-sectional side view of a lower portion of a makeup extension wand system with the cover removed, taken along section line 3C-3C of FIG. 3A, according to an embodiment of the invention.
Figure 3E:
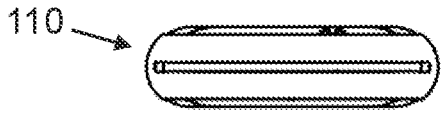
FIG. 3E is a top view of a makeup extension wand system with the cover removed, according to an embodiment of the invention.
Figure 3F:
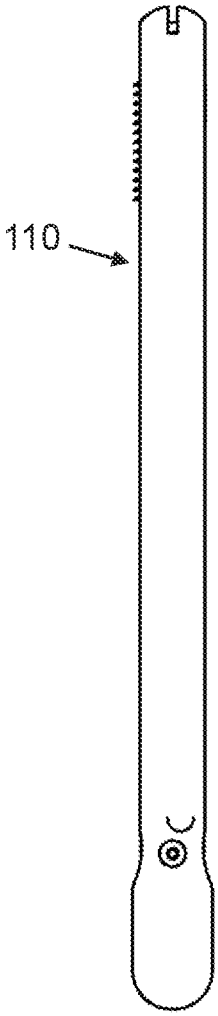
FIG. 3F is a left side view of a makeup extension wand system with the cover removed, according to an embodiment of the invention.
Figure 3G:
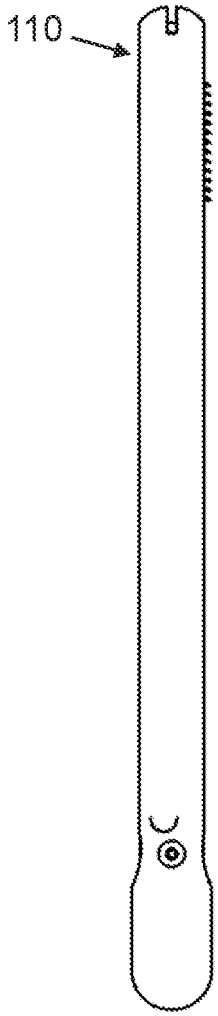
FIG. 3G is a right side view of a makeup extension wand system with the cover removed, according to an embodiment of the invention.
Figure 3H:
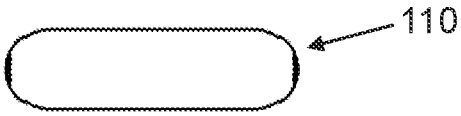
FIG. 3H is a bottom view of a makeup extension wand system with the cover removed, according to an embodiment of the invention.

In a related embodiment, as shown in FIGS. 3C and 3D, each connector portion 132 can be configured as a front offset connector portion 334 or a rear offset connector portion 336, such that the outer end of end of the connector portion 132 can be configured with a front side lateral offset 335 or a rear side lateral offset 337, wherein:

a) A front offset extension wand assembly 330 can include a front offset connector portion 334 with a front side offset 335, such that the extension shaft 136 and applicator tip 138 is positioned in a front portion 372 of the frame opening 219, when the corresponding extension wand assembly 130 is rotated to a vertical orientation inside the frame opening 219; and b) A rear offset extension wand assembly 331 can include a rear offset connector portion 336 with a rear side offset 337, whereby the extension shaft 136 and applicator tip 138 is positioned in a rear portion 374 of the frame opening 219, when the corresponding extension wand assembly 130 is rotated to a vertical orientation inside the frame opening 219.

In related embodiment, the plurality of extension wand assemblies 130 can include:

a) a first plurality of front offset extension wand assemblies 330, wherein each front offset extension wand assembly 330 includes a front offset connector portion 334 with a front side lateral offset 335, relative to a center 322 of the stationary axle 220, such that an elongated axis of a detachable shaft assembly 134 of each front offset extension wand assembly 330 is configured with the front side lateral offset 335, relative to a vertical center plane 324 of the stationary axle 220, such that each front offset detachable shaft assembly 134 of the first plurality of front offset extension wand assemblies 330 is positioned in front 372 of the vertical center plane 324 of the frame 111; and b) a second plurality of rear offset extension wand assemblies 331, wherein each rear offset extension wand assembly 331 includes a rear offset connector portion 336 with a rear side lateral offset 337, relative to a center 322 of the stationary axle 220, such that an elongated axis of a detachable shaft assembly 134 of each rear offset extension wand assembly 331 is configured with the rear side lateral offset 337, relative to a vertical center plane 324 of the stationary axle 220, such that each rear offset detachable shaft assembly 134 of the second plurality of rear offset extension wand assemblies 331 is to a rear 374 of the vertical center plane 324 of the frame 111.

In a further related embodiment, as shown in FIGS. 3A and 4A, the body 110 can further include:

a) a separator sheet 360, which can be a flat sheet, which can be transparent, translucent, opaque, mirrored, reflective, colored, illustrated, and can be made of plastic or other suitable materials;

wherein the separator sheet 360 can be connected to the frame inside an upper portion of the frame opening 219, between:

i. upper portions of the first plurality of front offset extension wand assemblies 330, and ii. upper portions of the second plurality of front offset extension wand assemblies 331;

whereby the separator sheet minimizes contact (and related smudging and contamination) between first applicator tips 138 of the first plurality of front offset extension wand assemblies 130 and second applicator tips 138 of the second plurality of rear offset extension wand assemblies 331.

Figure 8C:
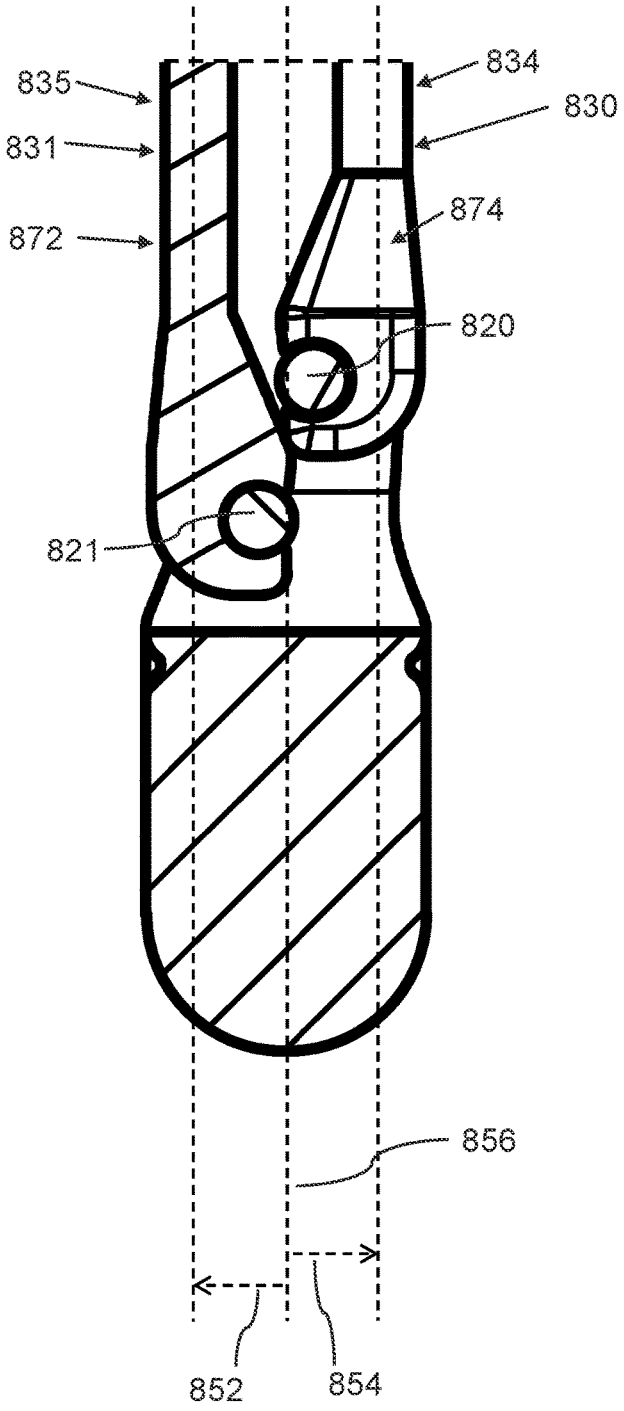
FIG. 8C is a cross-sectional side view of a lower portion of the dual-axle makeup extension wand system, taken along section line 8B-8B of FIG. 8A, according to an embodiment of the invention.

In an alternative related embodiment, as shown in FIGS. 8A, 8B, and 8C, a dual-axle makeup extension wand system can be configured with two axles 820, 821, wherein the body 810 can further include:

a) a first stationary axle 820, which can be connected between the left and right vertical frame segments 212, 214 in a lower portion of the frame opening 219; and b) a second stationary axle 821, which can be connected between the left and right vertical frame segments 212, 214 in a lower portion of the frame opening 219;

wherein the second stationary axle 821 is positioned below or above the first stationary axle 820, such that the second stationary axle 821 is vertically displaced from the first stationary axle 820;

wherein the first stationary axle 820 is configured with a front axle offset 852;

wherein the second stationary axle 821 is configured with a rear axle offset 854;

wherein the plurality of extension wand assemblies 130 comprises a first plurality of extension wand assemblies 830 and a second plurality of extension wand assemblies 831;

such that the inner end of each extension wand assembly 830 in the first plurality of extension wand assemblies 830 is rotatably connected to the first stationary axle 820;

such that the inner end of each extension wand assembly 831 in the second plurality of extension wand assemblies 831 is rotatably connected to the second stationary axle 821;

such that each detachable shaft assembly 834 of the first plurality of extension wand assemblies 830 is positioned in front 872 of a vertical center plane 856 of the frame 811; and such that each detachable shaft assembly 835 of the second plurality of extension wand assemblies 831 is positioned to a rear 874 of the vertical center plane 856 of the frame 811.

In further related embodiments, a makeup extension wand system 100 can be configured with at least one, two, three or more axles 220, which each can be mounted with at least one or a plurality of extension wand assemblies 130.

In a related embodiment, the makeup extension wand system 100 can be made of metal, plastic, glass fiber, carbon fiber, fiber composites, or a combination of these. The extension shafts 136 can be made of plastic, such as polypropylene or ABS; and the applicator tip 138 can for example be made of nylon bristles, sponge or foam, or a flocked material.

Thus, in a related embodiment, the makeup extension wand system 100 can include two or more five wand assemblies 130, such as at least five wand assemblies 130, each with a different applicator tip 138 for a particular makeup application, such as mascara, lipstick, lip gloss, etc. The wand assemblies 130 can be detachable for cleaning and replacement of tips, shafts, or an entire wand assembly. The makeup extension wand system 100 can include a body/holder/frame 110, 111, such that the wand assemblies 130 can be detachably and pivotably connected to the holder/frame 110, 111.

Here has thus been described a multitude of embodiments of the makeup extension wand system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A makeup extension wand system, comprising:

a) a body, which comprises:

a frame, which comprises:

a left vertical frame segment and a right vertical frame segment;

wherein the frame forms a frame opening between the left vertical frame segment and the right vertical frame segment;

wherein the frame comprises a vertical center plane; and at least one stationary axle, which comprises:

a first stationary axle, which is connected between the left vertical frame segment and the right vertical frame segment, in a lower portion of the frame opening; and a second stationary axle, which is connected between the left vertical frame segment and the right vertical frame segment, in the lower portion of the frame opening;

wherein the second stationary axle is vertically displaced from the first stationary axle;

wherein the first stationary axle is configured with a front axle offset; and wherein the second stationary axle is configured with a rear axle offset; and b) a plurality of extension wand assemblies, wherein an outer portion of each extension wand assembly in the plurality of extension wand assemblies is configured for use to extract makeup from a makeup container, such that the makeup is deposited on the outer portion, such that the outer portion is used to apply the makeup, wherein each extension wand assembly in the plurality of extension wand assemblies comprises:

an extension shaft, wherein an inner end of the extension shaft is detachably and rotatably connected to the body;

an applicator tip, which is connected to an outer end of the extension shaft, such that the applicator tip is configured for use to extract and apply the makeup; and a connector portion, wherein an outer end of the connector portion is detachably connected to the inner end of the extension shaft; and wherein an inner end of the connector portion is rotatably connected to one of the at least one stationary axle;

wherein the extension shaft and the applicator tip form a detachable shaft assembly;

wherein the plurality of extension wand assemblies further comprises:

a first plurality of extension wand assemblies each comprising the respective connector portion having a front side lateral offset such that the respective detachable shaft assembly is positioned in front of the vertical plane of the frame; and a second plurality of extension wand assemblies each comprising the respective connector portion having a rear side lateral offset such that the respective detachable shaft assembly is positioned to the rear of the vertical plane of the frame;

wherein an inner end of each of the first plurality of extension wand assemblies is rotatably connected to the first stationary axle and an inner end of each of the second plurality of extension wand assemblies is rotatably connected to the secondary stationary axle such that each extension wand assembly is rotatable to a folded-in orientation for storage of the extension wand assembly and to a folded-out orientation for use of the extension wand assembly such that the extension shaft is detachable with the applicator tip exposed for use, wherein each detachable shaft assembly projects upward when positioned in the folded-in orientation.

2. The makeup extension wand system of claim 1, wherein the outer end of the connector portion further comprises:

a connector aperture, wherein the inner end of each extension shaft is configured to slide into the connector aperture, wherein each detachable shaft assembly is releasably held in position between the connector aperture and the inner end of the extension shaft.

3. The makeup extension wand system of claim 1, wherein the outer end of the connector portion comprises:

a snap-lock connector, wherein the inner end of the extension shaft is configured to detachably snap into the snap-lock connector.

4. The makeup extension wand system of claim 1, wherein the outer end of the connector portion comprises:

a threaded aperture, wherein the inner end of the extension shaft is threaded, wherein the inner end of the extension shaft is configured to screw into the threaded aperture.

5. The makeup extension wand system of claim 1, wherein the connector portion further comprises:

a central aperture, wherein the connector portion is configured to slide onto the at least one stationary axle, wherein the at least one stationary axle protrudes trough the central aperture.

6. The makeup extension wand system of claim 5, wherein the inner end of the connector portion is detachably connected to the at least one stationary axle; and wherein the inner end of the connector portion further comprises a flexible snap-in opening, which is connected to the central aperture, wherein each connection portion is configured to detachably snap onto the at least one stationary axle.

7. The makeup extension wand system of claim 1, wherein the frame further comprises:

a) a top horizontal frame segment, which is connected between top ends of the left vertical frame segment and the right vertical frame segment; and b) a bottom horizontal frame segment, which is connected between bottom ends of the left vertical frame segment and the right vertical frame segment;

wherein the frame opening is formed between the left vertical frame segment and the right vertical frame segment and the top horizontal frame segment and the bottom horizontal frame segment.

8. The makeup extension wand system of claim 1, wherein the inner end of the connector portion is detachably connected to the at least one stationary axle.

9. The makeup extension wand system of claim 1, wherein each applicator tip is selected from the group consisting of:

a) a liquid eyeliner applicator tip configured to extract and apply liquid eyeliner makeup;

b) a mascara applicator tip configured to extract and apply mascara makeup;

c) a lip gloss applicator tip configured to extract and apply lip gloss makeup;

d) a lip stick applicator tip configured to extract and apply lip stick makeup; and e) a foundation applicator tip configured to extract and apply foundation makeup.

10. The makeup extension wand system of claim 1, wherein the plurality of extension wand assemblies comprises:

a) a first extension wand assembly, comprising a first applicator tip configured as a liquid eyeliner applicator tip configured to extract and apply liquid eyeliner makeup;

b) a second extension wand assembly, comprising a second applicator tip configured as a mascara applicator tip configured to extract and apply mascara makeup;

c) a third extension wand assembly, comprising a third applicator tip configured as a lip gloss applicator tip configured to extract and apply lip gloss makeup;

d) a fourth extension wand assembly, comprising a fourth applicator tip configured as a lip stick applicator tip configured to extract and apply lip stick makeup; and e) a fifth extension wand assembly, comprising a fifth applicator tip configured as a foundation applicator tip configured to extract and apply foundation makeup.

11. The makeup extension wand system of claim 1, wherein at least a surface portion of the applicator tip is made from a rubber material.

12. The makeup extension wand system of claim 1, wherein at least a surface portion of the applicator tip is made from a flocked material.

13. The makeup extension wand system of claim 1, wherein the body further comprises:

a separator sheet;

wherein the separator sheet is connected to the frame inside an upper portion of the frame opening, and between upper portions of the first plurality of front offset extension wand assemblies and upper portions of the second plurality of rear offset extension wand assemblies;

wherein the separator sheet is configured to minimize contact between the applicator tips of the first plurality extension wand assemblies and the applicator tips of the second plurality extension wand assemblies.

14. The makeup extension wand system of claim 1, further comprising:

a cover configured to removably slide over at least an upper part of the body, wherein the plurality of extension wand assemblies are covered by the cover, when each of the extension wand assemblies are positioned in the folded-in orientation.

15. A makeup extension wand system, comprising:

a) a frame, which comprises:

a left vertical frame segment; and a right vertical frame segment;

wherein the frame forms a frame opening between the left vertical frame segment and the right vertical frame segment;

wherein the frame comprises a vertical center plane; and b) a first stationary axle, connected between the left vertical frame segment and the right vertical frame segment, in a lower portion of the frame opening;

c) a second stationary axle, connected between the left vertical frame segment and the right vertical frame segment, in the lower portion of the frame opening;

wherein the second stationary axle is vertically displaced from the first stationary axle wherein the first stationary axle is configured with a front axle offset;

wherein the second stationary axle is configured with a rear axle offset;

wherein a first center axis of the first stationary axle is positioned in front of the vertical center plane of the frame; and wherein a second center axis of the second stationary axle is positioned to a rear of the vertical center plane of the frame;

d) a plurality of extension wand assemblies, wherein an outer portion of each extension wand assembly in the plurality of extension wand assemblies is configured for use to extract makeup from a makeup container, wherein the makeup is deposited on the outer portion, wherein the outer portion is used to apply the makeup, wherein each extension wand assembly in the plurality of extension wand assemblies comprises:

an extension shaft, wherein an inner end of the extension shaft is detachably and rotatably connected to the body;

an applicator tip, which is connected to an outer end of the extension shaft, such that the applicator tip is configured for use to extract and apply the makeup; and a connector portion, wherein an outer end of the connector portion is detachably connected to an inner end of the extension shaft; and wherein an inner end of the connector portion is rotatably connected to the first stationary axle or the second stationary axle;

wherein the extension shaft and the applicator tip form a detachable shaft assembly;

wherein the plurality of extension wand assemblies further comprises:

a first plurality of extension wand assemblies each comprising the respective connector portion having a front side lateral offset such that the respective detachable shaft assembly is positioned in front of the vertical plane of the frame; and a second plurality of extension wand assemblies each comprising the respective connector portion having a rear side lateral offset such that the respective detachable shaft assembly is positioned to the rear of the vertical plane of the frame;

wherein each of the extension wand assembly in the plurality of extension wand assemblies is rotatably connected to the first stationary axle or the second stationary axle, such that each of the extension wand assembly is rotatable to a folded-in orientation for storage of the extension wand assembly and to a folded-out orientation for use of the extension wand assembly, such that the extension shaft is detachable with the applicator tip exposed for use;

wherein an inner end of each of the extension wand assembly in the first plurality of extension wand assemblies is rotatably connected to the first stationary axle, and an inner end of each of the second plurality of extension wand assemblies is rotatably connected to the secondary stationary axle, wherein each detachable shaft assembly projects upward when positioned in the folded-in orientation.

16. A makeup extension wand system, comprising:

a) a frame, which comprises:

a left vertical frame segment; and a right vertical frame segment;

wherein the frame forms a frame opening between the left vertical frame segment and the right vertical frame segment;

wherein the frame comprises a vertical center plane; and b) a first stationary axle, connected between the left vertical frame segment and the right vertical frame segment, in a lower portion of the frame opening;

c) a second stationary axle, connected between the left vertical frame segment and the right vertical frame segment, in the lower portion of the frame opening;

wherein the second stationary axle is vertically displaced from the first stationary axle;

wherein the first stationary axle is configured with a front axle offset;

wherein the second stationary axle is configured with a rear axle offset;

wherein a first center axis of the first stationary axle is positioned in front of the vertical center plane of the frame; and wherein a second center axis of the second stationary axle is positioned to a rear of the vertical center plane of the frame; and d) a plurality of extension wand assemblies, wherein an outer portion of each extension wand assembly in the plurality of extension wand assemblies is configured for use to extract makeup from a makeup container, wherein the makeup is deposited on the outer portion, wherein the outer portion is used to apply the makeup, wherein each extension wand assembly in the plurality of extension wand assemblies comprises:

an extension shaft;

an applicator tip, which is connected to an outer end of the extension shaft, such that the applicator tip is configured for use to extract and apply the makeup;

wherein the extension shaft and the applicator tip forms a detachable shaft assembly; and a connector portion, wherein an outer end of the connector portion is detachably connected to an inner end of the extension shaft; and wherein an inner end of the connector portion is rotatably connected to a corresponding stationary axle of the first stationary axle and the second stationary axle, wherein the connector portion further comprises:

a central aperture, wherein the connector portion is configured to slide onto a corresponding stationary axle of the first stationary axle and the second stationary axle, wherein the corresponding stationary axle protrudes trough the central aperture;

wherein the inner end of the connector portion is detachably connected to the first stationary axle or the second stationary axle; and wherein the inner end of the connector portion further comprises a flexible snap-in opening connected to the central aperture, wherein the connection portion is configured to detachably snap onto the first or the second stationary axle;

wherein the plurality of extension wand assemblies further comprises:

a first plurality of extension wand assemblies each comprising the respective connector portion having a front side lateral offset such that the respective detachable shaft assembly is positioned in front of the vertical plane of the frame; and a second plurality of extension wand assemblies each comprising the respective connector portion having a rear side lateral offset such that the respective detachable shaft assembly is positioned to the rear of the vertical plane of the frame;

wherein each of the extension wand assembly in the plurality of extension wand assemblies is rotatably connected to the first stationary axle or second stationary axle, wherein each of the extension wand assembly is rotatable to a folded-in orientation for storage of the extension wand assembly and to a folded-out orientation for use of the extension wand assembly, wherein the extension shaft is detachable with the applicator tip exposed for use;

wherein an inner end of each of the first plurality of extension wand assemblies is rotatably connected to the first stationary axle and an inner end of each of the second plurality of extension wand assemblies is rotatably connected to the secondary stationary axle, such that each extension wand assembly is rotatable to a folded-in orientation for storage of the extension wand assembly and to a folded-out orientation for use of the extension wand assembly, wherein each detachable shaft assembly projects upward when positioned in the folded-in orientation.

* * * * *